United States Patent [19]

Paris

[11] Patent Number: 4,551,929

[45] Date of Patent: Nov. 12, 1985

[54] UNIT-SOLED SHOE

[76] Inventor: John Paris, Apt. 6, 180 Andover St., Andover, Mass. 01810

[21] Appl. No.: 466,972

[22] Filed: Feb. 16, 1983

[51] Int. Cl.[4] ..... A43B 3/14

[52] U.S. Cl. ..... 36/11; 36/14; 36/22 R; 12/142 MC

[58] Field of Search ..... 36/11, 14, 19 R, 21, 36/22 R, 9 R, 25 R, 18, 24.5; 12/142 MC

[56] References Cited

U.S. PATENT DOCUMENTS

| | | | |
|---|---|---|---|
| 1,603,624 | 10/1926 | Miner . | |
| 2,236,600 | 4/1939 | LaChappelle | 12/142 |
| 2,627,677 | 2/1953 | Kashian | 36/11 X |
| 3,302,312 | 2/1967 | Hartley | 36/11 |
| 4,250,638 | 2/1981 | Linnemann | 12/142 MC X |
| 4,272,858 | 6/1981 | Hlustik | 36/11 X |
| 4,308,671 | 1/1982 | Bretschneider | 36/11 |

FOREIGN PATENT DOCUMENTS

| | | | |
|---|---|---|---|
| 2618183 | 11/1977 | Fed. Rep. of Germany | 36/11 |
| 1041535 | 10/1953 | France | 36/14 |
| 1141113 | 8/1957 | France | 36/11 |
| 764956 | 1/1957 | United Kingdom | 36/19 R |
| 1225155 | 3/1971 | United Kingdom | 36/21 |

*Primary Examiner*—Werner H. Schroeder
*Assistant Examiner*—T. Graveline

[57] ABSTRACT

A shoe in which a peripheral wall extends generally transverse to the ground-contacting and top sole surfaces, upwardly from the top sole surface along the periphery of its heel portion; the rearward portion of the shoe upper is attached to the inside of the sole wall; and the forward portion of the upper is attached only to the top surface of the sole.

9 Claims, 6 Drawing Figures

UNIT-SOLED SHOE

BACKGROUND OF THE INVENTION

This invention relates to unit-soled shoes.

In one style of unit-soled shoe the sole has an upwardly extending wall along the entire periphery of the top surface, and the upper is stitched to the inside of that wall.

SUMMARY OF THE INVENTION

In general, the invention features an improved construction in which the rearward portion of the upper is attached to the inside of the wall, and the forward portion of the upper is attached only to the top surface of the sole.

In the preferred embodiment, the wall extends only around the rear portion of the sole, and most preferably it extends forward of a first plane representing the shoe's arch at its maximum height, tapering downward to end rearward of a second plane representing the rear boundary of the shoe's break region; stitching extends through the side of the rearward portion of the upper and through the side of the wall; and that stitching overlaps, on the arch side of the shoe, other stitching which extends through the bottom of the forward portion of the upper and through the ground-contacting surface of the sole.

The shoe is particularly advantageous in that it has a simple, efficient construction which provides lateral support, as well as comfort and vertical flexibility. Specifically, the rear portion of the upper is easily stitched to the side of the wall, and the forward portion of the upper is easily stitched to the surface of the sole. The resulting shoe resists rotational deformation in the rear, and allows vertical flex in the front.

Other features and advantages of the invention will be apparent from the following description of the preferred embodiment and from the claims.

DESCRIPTION OF THE PREFERRED EMBODIMENT

I first briefly describe the drawings.

DRAWINGS

STRUCTURE

Figure 1:
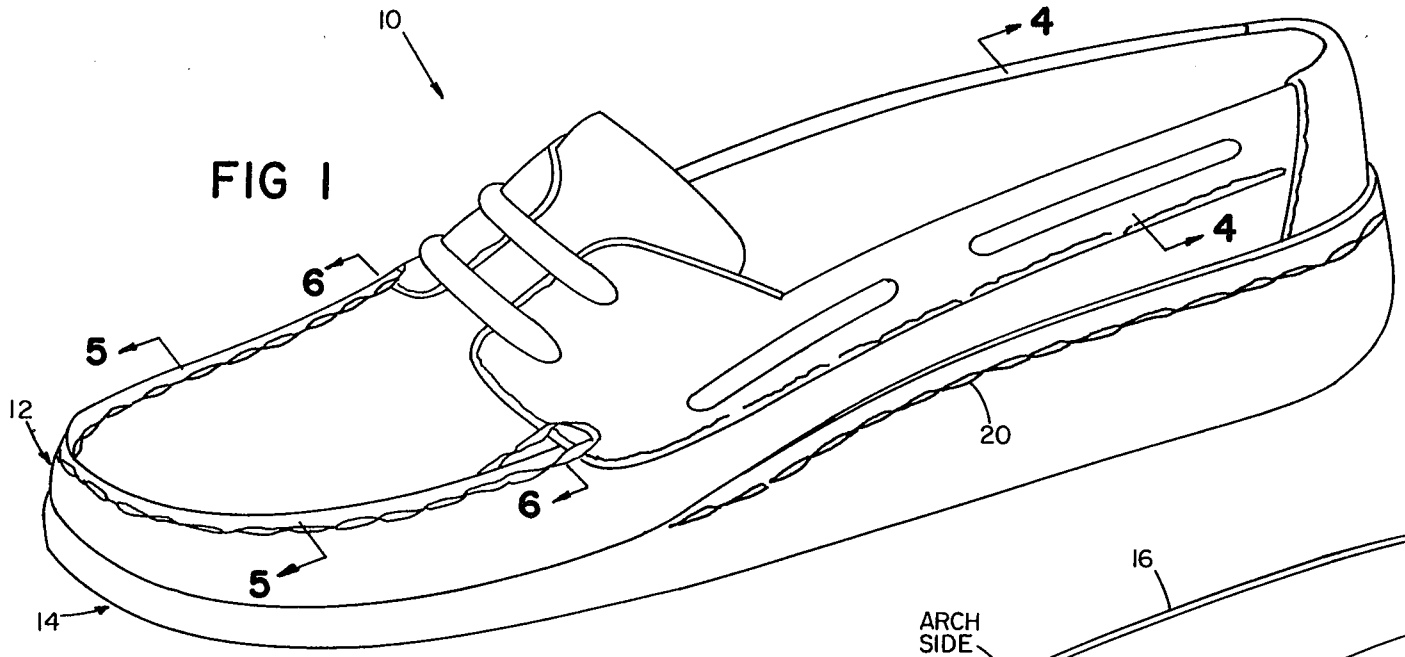
FIG. 1 is a perspective view of a left shoe.
Figure 2:
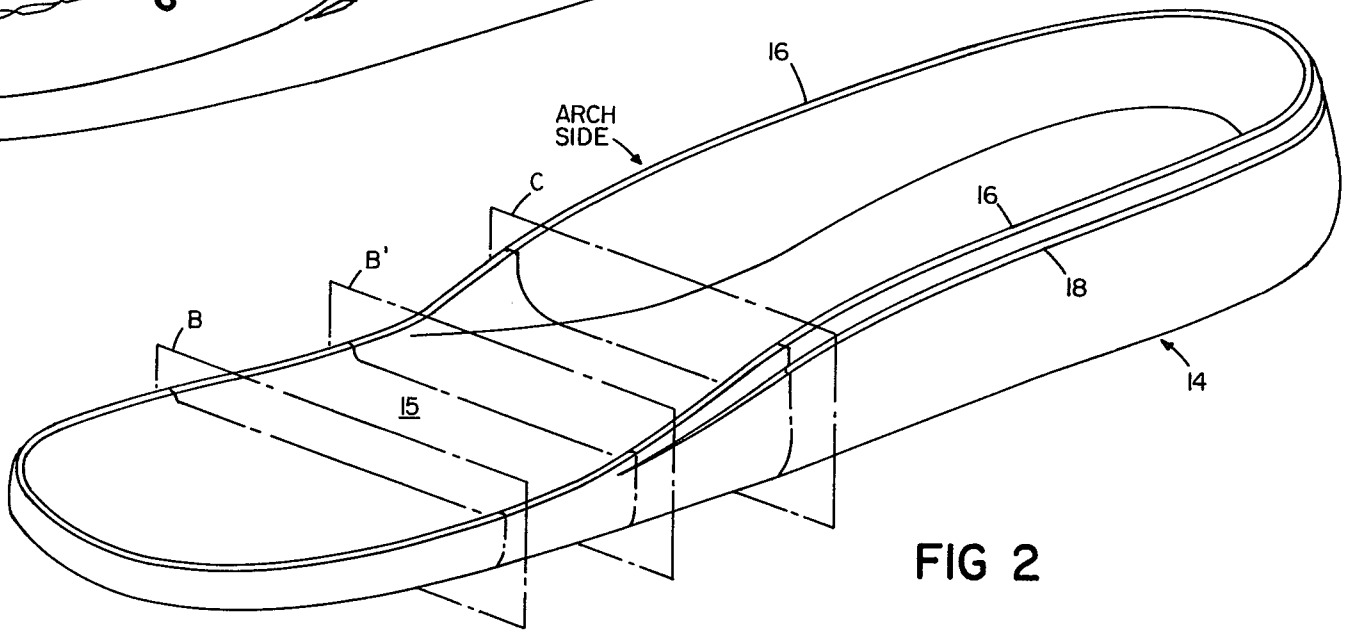
FIG. 2 is a perspective view of the unit sole of the shoe in FIG. 1.
Figures 3, 4, 5:
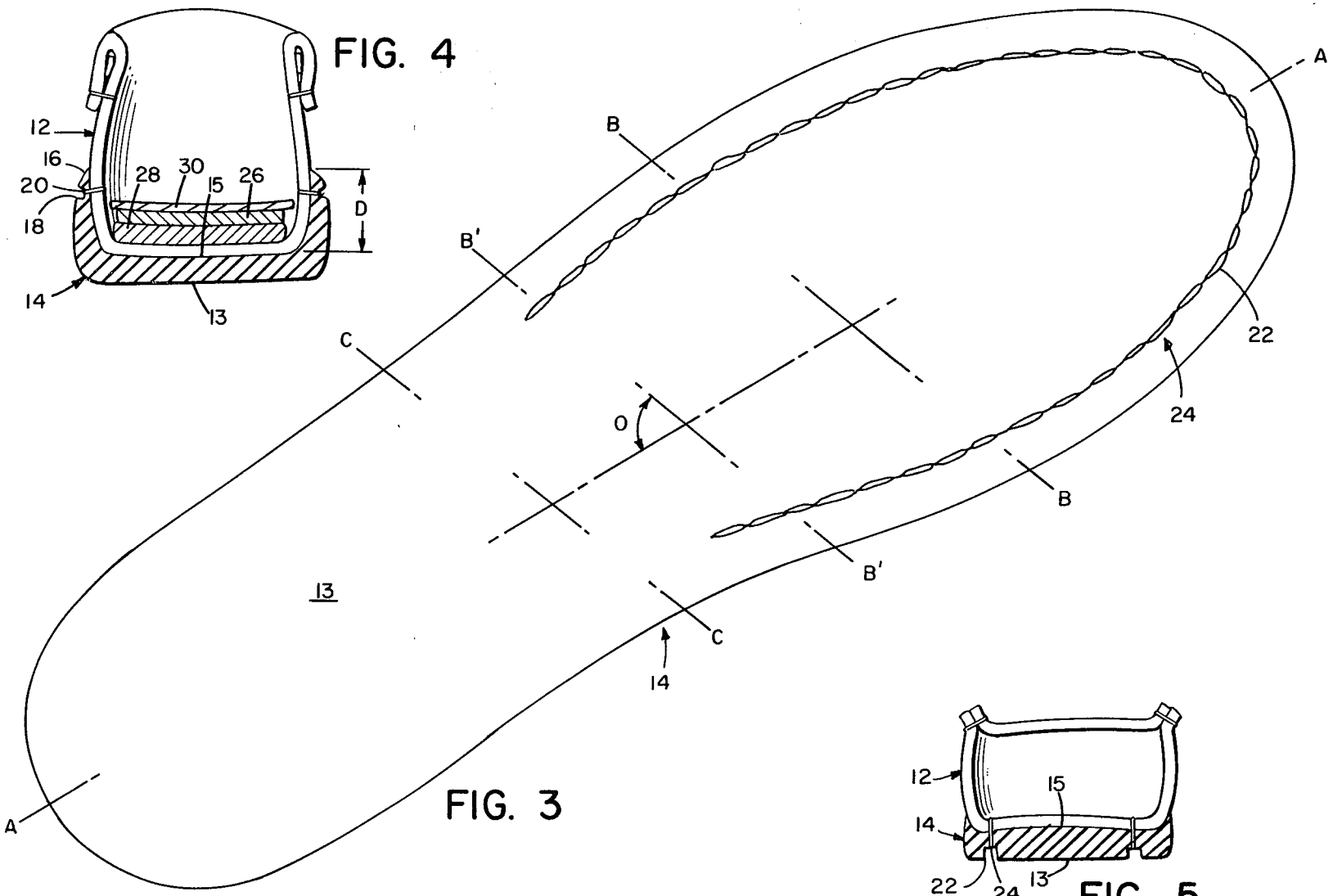
FIG. 3 is a plan view of the bottom of a unit sole of a right shoe that is the mate of the shoe of FIG. 1.
FIG. 4 is a cross section taken along 4—4 of FIG. 1.
FIG. 5 is a cross section taken along 5—5 of FIG. 1.

Turning to FIGS. 1-3, shoe 10 is a recreational shoe such as a boat shoe comprised of a leather upper 12 seated on and attached to and a unit sole 14 made from a molded rubber compound. Sole 14 has a ground-contacting surface 13 and a top surface 15 generally parallel thereto.

As best shown in FIG. 3, the shoe has a break region corresponding to the region of maximum flex when the user's foot is flexed. Specifically, as used herein, the term "rear boundary of the break region" means a vertical plane across the intended location of the center of the ball of the user's foot. As shown in FIG. 3, the rear boundary of the break region is a plane perpendicular to surface 13 of the sole through line B—B. The shoe also has an arch region, the center of which is denoted by a vertical plane intersecting surface 13 of the sole at line C—C (FIG. 3) and running roughly across the maximum arch of the shoe.

Sole 14 has an integral vertical wall 16 extending around the periphery of its rear portion. The wall begins rearward of the vertical plane through B—B (and, for maximum vertical flexibility, about ½ inch rearward of that plane) and tapers up gradually to its full height at the vertical plane through C—C. Preferably, the line B'—B' connecting the end points of the wall is transverse to the central longitudinal plane of the shoe (i.e., the plane perpendicular to the sole and intersecting it at line A—A, a line generally bisecting the sole longitudinally) so that angle 0 is about 60°-80°.

The wall is continuous around the portion of the shoe rear of the plane through C—C, and, in that region, generally has a height "D" (as measured from the top surface of the sole to the top of the wall) of at least ½ inch and preferably, for additional lateral stability, at least ⅞ inch. Wall 16 is about 3/32 inch thick.

Wall 16 has a groove 18 about 1/32 inch deep extending along the side of the wall for its entire length, about 1/16 inch from the top of the wall. Stitching 20 is accomodated in groove 18 and extends through the wall and through the side of the upper.

The fronts of upper 12 and sole 14 are attached by stitching 22 through the bottom of the sole and through the bottom of upper 14. Groove 24 extends around the bottom of the sole about 3/32 inch from the edge, and stitching 22 is accomodated in groove 24.

Stitching 22 ends at points forming a line perpendicular to the central longitudinal plane of the shoe, and, because the wall may extend further foward on the inner side of the shoe, stitching 22 overlaps stitching 20 on the arch side but not necessarily the outer side of the shoe.

Figure 6:
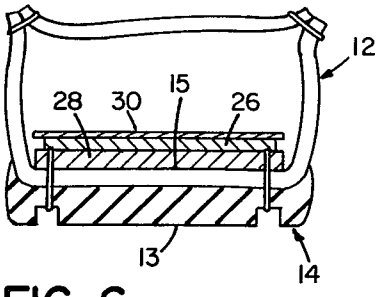
FIG. 6 is a cross-section taken along 6—6 of FIG. 1.

A shank 28 is attached inside the upper, on the bottom of the rear portion thereof. Shank 28 extends far enough forward so that it overlaps about one inch of stitching 22, and, in that region referring to FIG. 6, the stitching extends through the shank, helping to attach it to the upper. A pad 26 is located under sock liner 30, and both are positioned inside the upper on top of the shank.

MANUFACTURE

The construction of upper 12 is that of a leather boat-shoe upper, having its bottom integral with the side walls. Sole 14 is molded from a rubber compound. The sole and upper are joined by separate stitchings 20 and 22.

The rear of sole 14 is attached to upper 12 by fastening stitching 20 in groove 18 through wall 16, and through the side of leather upper 12. Stitching 20 extends around the entire back of the shoe rearward of plane B, and extends substantially to the end of wall 16. The stitching may be accomplished by machines known in the trade as Littleway machines or comparable machines, e.g., Feemach machines. Similarly, the front of sole 14 is attached to the bottom of upper 12 by fastening stitching 22 in groove 24. The attachment between the upper and sole is augmented with adhesives commonly used for such purposes.

USE

In use, the shoe is comfortable and flexible, and provides considerable lateral support. The rear portion of the shoe resists rotational deformation—e.g., twisting from unexpectedly landing on a non-horizontal surface. At the same time, the shoe readily allows vertical flex in the front—e.g., when the wearer, in normal walking, places weight on the ball of his foot and lifts his heel, causing a break across the front of the shoe.

OTHER EMBODIMENTS

Other embodiments are within the following claims. For example, the wall need not taper gradually downward in height toward its end points, and may instead end relatively abruptly between the planes through C—C and B—B respectively. The means for attaching the sole to the upper may be any suitable glue or adhesive, without stitching.

I claim:

1. A shoe comprising a sole having a ground-contacting surface, a top surface generally parallel to said ground-contacting surface, and a peripheral wall extending generally transverse to said ground-contacting and top surfaces, upwardly from said top surface, and along the periphery of the heel portion of said sole, said wall extending only around the rear portion of said sole and an upper having rearward and forward portions and attached at its rearward portion to an inside surface of said wall, and, at its forward portion, attached only to said top surface.

2. The sole of claim 1 further comprising an arch of varying height, and further characterized in that a portion of said wall extends forward of a first plane representing the shoe arch at its maximum height.

3. The shoe of claim 1 further comprising stitching extending through the side of said rearward upper portion and through the side of said wall.

4. The shoe of claim 1 further comprising stitching extending through the bottom of said forward upper portion and through said ground-contacting surface of said sole.

5. The shoe of claim 4 further comprising a generally planar shank positioned inside said upper and extending parallel to said top sole surface a portion of said stitching extending through a forward portion of said shank.

6. The shoe of claim 1 further characterized in that said wall lies entirely rearward of a second plane representing the rear boundary of the shoe's break region.

7. The shoe of claim 6 further characterized in that said wall tapers downward in height in the region from said first plane to said second plane.

8. The shoe of claim 1 further characterized in that said shoe has an arch side and an opposite outer side, said wall begins at one point and terminates at another point along the periphery of said sole, and the line connecting the end points of said wall is transverse to the central longitudinal plane of the shoe, said line being further forward on the arch side of said shoe.

9. The shoe of claim 8 further characterized in that a first stitching extends through the side of said rearward upper portion and through the side of said wall, terminating at one end at a first point on the arch side of said shoe, a second stitching extends through the bottom of said forward upper portion and through said ground-contacting surface, terminating at one end at a second point on the arch side of said shoe, and said first point lies further forward than said second point.

* * * * *